US005269531A

United States Patent [19]

McNamara

[11] Patent Number: 5,269,531

[45] Date of Patent: Dec. 14, 1993

[54] BOARD GAME

[75] Inventor: Thomas McNamara, Auckland, New Zealand

[73] Assignee: Connections International Limited, Auckland, New Zealand

[21] Appl. No.: 785,159

[22] Filed: Oct. 31, 1991

Related U.S. Application Data

[63] Continuation of Ser. No. 550,577, Jul. 10, 1990, abandoned.

[30] Foreign Application Priority Data

Jul. 18, 1989 [NZ] New Zealand ..... 229.978

[51] Int. Cl.[5] ..... A63F 3/00

[52] U.S. Cl. ..... 273/275; 273/264; 273/271; 273/282.1

[58] Field of Search ..... 273/275, 271, 267, 264, 273/258, 239, 236, 260, 261, 282.1

[56] References Cited

U.S. PATENT DOCUMENTS

| | | | |
|---|---|---|---|
| 1,666,359 | 4/1928 | Steves | 273/267 |
| 3,024,026 | 8/1962 | Goetz | 273/275 |
| 3,404,890 | 10/1968 | Christy | 273/275 |
| 3,695,614 | 10/1972 | Shoptaugh | 273/130 R |
| 4,067,577 | 1/1978 | Minty, Jr. | 273/275 |

FOREIGN PATENT DOCUMENTS

| | | | |
|---|---|---|---|
| 2184660 | 7/1987 | United Kingdom | 273/275 |

*Primary Examiner*—V. Millin
*Assistant Examiner*—William M. Pierce
*Attorney, Agent, or Firm*—Jacobson, Price, Holman & Stern

[57] ABSTRACT

A board game has two sets of nodes fixed to the board in a pattern with the sets intermingled in an orderly manner. Two sets of game pieces matching the two sets of nodes are provided. The game is played by each of two players trying to complete an enclosure the edges of which are made up of nodes and game pieces.

1 Claim, 2 Drawing Sheets

BOARD GAME

This is a continuation of application Ser. No. 07/550,577, filed Jul. 10, 1990 now abandoned.

This invention relates to a board game.

It is an object of the present invention to provide a board game which will at least provide the public with a useful choice.

Accordingly the invention consists in a board game comprising a set of rules and a real or simulated board having two distinguishable sets of nodes, each set of nodes being fixed to the board in a pattern and the sets being intermingled in an orderly manner and two of sets of distinguishable real or simulated game pieces, each set of game pieces being shaped coloured or having indicia thereon identifiable with one of said sets of nodes, in use of the game each player being allocated one of said sets of game pieces and a corresponding one of said sets of nodes, the players then placing game pieces on said board relative to said nodes to achieve a desired pattern of game pieces and nodes in accordance with said set of rules with each player endeavouring to gain an advantage over the other.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The invention consists in the foregoing and also envisages constructions of which the following gives examples only.

One preferred form of the invention will now be described with reference to the accompanying drawings in which.

Figure 1:
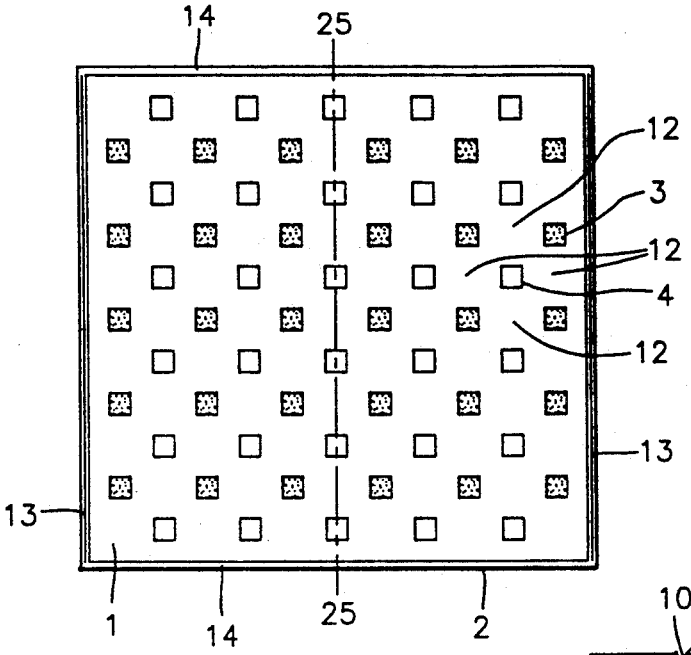
FIG. 1 is a diagrammatic plan view of a playing board with no tiles thereon.

Referring to the drawings FIG. 1 shows a playing board 1 having raised edges 2 and two sets of nodes 3 and 4. Each node is of suitable shape e.g. square and is raised above the surface of the playing board. The sets of nodes are distinguishable from each other e.g. being distinguished by shape, colour, or indicia thereron. In the preferred embodiment sets of nodes are in rows of nodes traversing the playing board, with adjacent rows being different colours.

Figure 2:
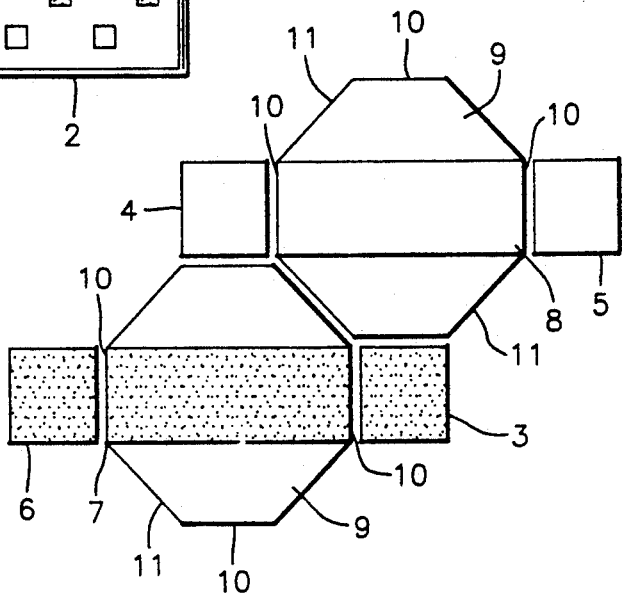
FIG. 2 is a diagrammatic plan view of two game pieces placed between nodes.

Any one node in a row of any colour is directly opposite a gap between nodes in adjacent rows, the rows and nodes being spaced so as to achieve a symmetrical pattern of nodes across the surface of the playing board. In FIG. 2 white node 4 is shown opposite spaces 12 between adjacent rows of black nodes.

A game piece 9 having an irregular octagonal shape is shown in FIG. 2. Game piece 9 has identifying means selected from shape, colour, or indicia thereon. In the preferred embodiment, illustrated in FIG. 2, a game piece has distinguishing indicia thereon in the form of an inlaid band of colour, traversing the game piece from one edge to the edge directly opposite as shown. The four sides 10 of a game piece between two of which coloured band 7 or 8 is located are shorter in length than the four sides 11. This allows game pieces to be placed between any four nodes as shown in FIG. 2. The playing board of FIG. 1 is intended to be used with a total of forty game pieces for the game to be played. The colour of the band 7 or 8 (FIG. 2) in one half of the game pieces matches one of the colours of the nodes on the playing board, the colour of the other half of the game pieces matches the colour of the other nodes on the playing board. The edges 2 of the board 1 also have coloured stripes or beads of coloured material inlaid along the upper surfaces of the edges. Black stripes 13 are provided on opposite edges of the board nearest black edge nodes and white stripes 14 are provided on opposite edges of the board nearest white edge nodes.

Two players are required to play the game, each person being provided with at least twenty game pieces of one colour. One player initiates play by placing a game piece on the playing board, positioning the game piece between two nodes of the same colour as that of the coloured band inlaid in the game piece so that the coloured band inlaid in the game piece forms a continuous area of one colour between and including the two nodes. FIG. 2 shows two game pieces having inlaid bands of colours 7 and 8 correctly positioned between nodes 3 and 6 and 4 and 5. Placing a game piece of one colour between nodes of a different colour, or placing a game piece in such a way that the band of colour inlaid in the game piece does not form a continuous area of one colour between and including two nodes is disallowed. The two players must place one game piece at a time on the playing board, taking turns alternately. The rules and instructions provided with the board and game pieces as sold for playing the game are as follows, the game pieces being called tiles and the nodes being called colour points;

RULES AND INSTRUCTIONS

Equipment 40 tiles (20 light, 20 dark)

Connection board with 60 raised nodes called colour points (30 each colour).

Instructions:

The players take turns, placing one tile on the board at each turn. The tiles must be placed so that their coloured strip connects end to end with matching colour points on the board.

3 Ways to Win

1. Form an unbroken connection of your colour across the board from any edge to the edge directly opposite.

2. Encircle one of your opponent's colour points.

3. Encircle one or more of your opponent's tiles with an unbroken connection of your colour.

Figure 3:
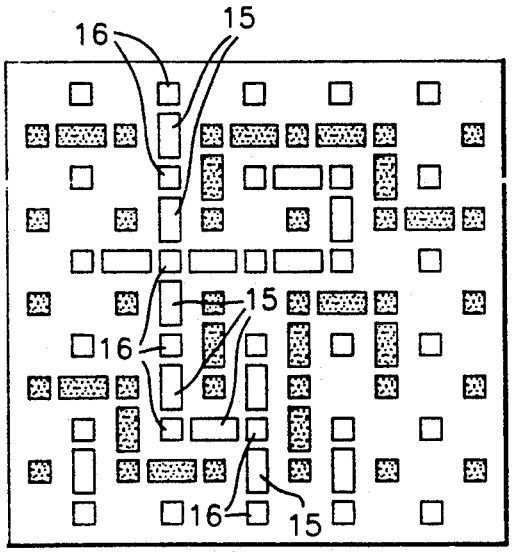
FIGS. 3, 4 and 5 are diagrammatic plan views of the playing board shown in FIG. 1, with a number of game pieces placed thereon.

Referring to FIG. 3, a player may win by placing game pieces in such a way as to form a continuous "connection", or uninterrupted line of one colour 8 from any edge node, being a node nearest the edge of the playing board, to an edge node in the row of nodes the same colour on the side of the board directly opposite. The inlaid strips or beads of coloured material 13 and 14 help clarify the edges of the board between which players should attempt to make a continuous uninterrupted line of one colour. For example a player with black game pieces will try to make a continuous line of black nodes and game pieces between the edge nodes nearest the edges with black strips 13. Srips 13 and 14 may be replaced with words or indicia e.g. the name of the game inlaid in the appropriate colour on the edges of the board.

Alternatively a player may win by placing game pieces in such a way as to form a geometric pattern encircling a node, or one or more game pieces, of the opposing player's colour. Winning patterns of game piece indicia with respect to nodes provided with the board and game pieces as sold are as follows;

1. White wins by making continuous connection from side to side.
2. White wins by surrounding a red colour point.
3. White wins by surrounding a red tile.

Winning pattern number 1 is shown in FIG. 3, wherein a continuous line of white game pieces referenced 15 and nodes 16 extends from the white edge nodes on one side of the board to those on the opposite side.

Figure 4:
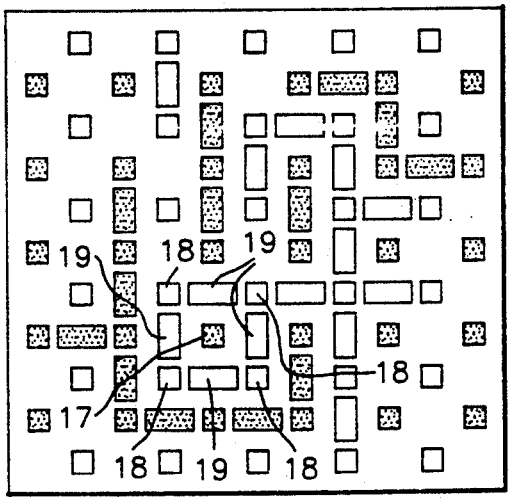

Winning pattern number 2 is shown in FIG. 4, wherein a black (as shown in FIG. 4) or a red node, referenced 17 is surrounded by white nodes 18 connected together by white game pieces 19.

Figure 5:
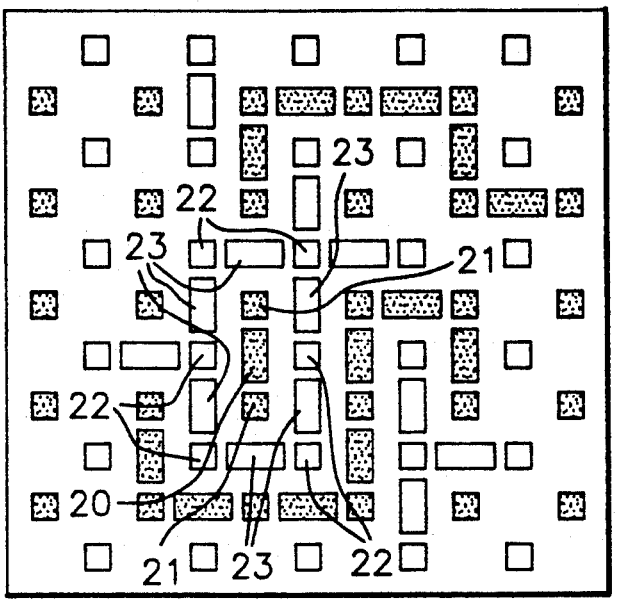

Winning pattern number 3 is shown in FIG. 5, wherein a black or red game piece 20, positioned between two red or black nodes 21 is surrounded by white nodes 22 connected together by white game pieces 23. The small gaps between game pieces and nodes have been exaggerated in FIGS. 3 to 5 in order to clearly portray the position of game pieces with respect to nodes.

In order that the game may be played in conditions which are not ideal e.g. when the players are travelling in a vehicle for instance where they are playing in a confined space and movement of the vehicle may disrupt the game pieces on their positions on the board another embodiment has been devised. Therefore in an alternative form the game may also be played with the board and game pieces having magnetic material incorporated therein such that the game pieces, when placed between nodes in accordance with the rules of the game, are not easily displaced. A magnetic material may be inlaid for example within the game pieces and within the nodes on the board. Magnetic material may also be placed within the playing board itself, being located underneath the playing surface of the board between nodes. The board is also of a smaller size than that of the preferred embodiment described above. Therefore the game pieces are smaller, and the board also has a hinge or hinges located along dotted line 25 in FIG. 1, such that the board may be folded in half when not in use, therefore taking up very little space and being easily transportable.

The game may also be played with a similated board and game pieces displayed on a television or VDU screen, such that two players may play the game without the board and game pieces being physically required, or one person may play the game against a machine. The electronics and software are associated with the VDU to provide appropriate graphical display capability to depict a similated board including nodes similated to provide game pieces to give the same effect as those shown in the drawings.

Such electronics comprise for example a programmable computer being connected to the VDU such that desired information may be output from the computer and displayed on the VDU.

To implement the game on such a computer, software comprising a computer program is written in a known way in accordance with the rules of the game as described above and the desired form of visual output to be displayed by the VDU.

From the drawings it can be seen that the board, nodes and the game pieces which are placed therebetween are easily represented in plan view on a VDU. A VDU which is capable of representing colours is not necessary, since only black and white are required to portray the game and therefore a VDU having black and white colour capability is sufficient.

Portrayal of the similated game pieces when situated between nodes is for example as shown in FIGS. 3 to 5 of the drawings. In FIGS. 3 to 5 the inlaid band of colour in each game piece is the only part of the game piece shown for purposes of clarity. Similarly, once the board as shown in FIG. 1 is depicted on the VDU, the game pieces when placed between the nodes need only be shown as coloured directional rectangles.

Figure 6:
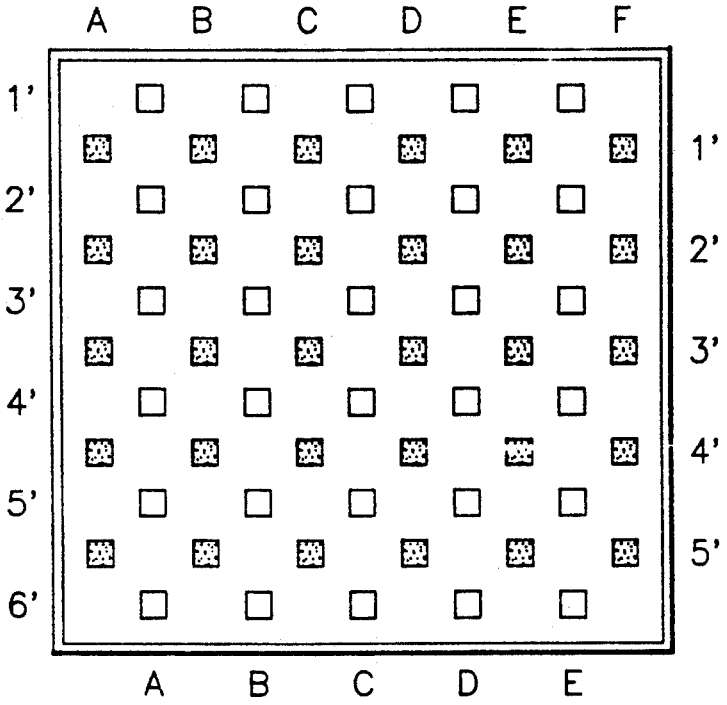
FIG. 6 is a diagrammatic plan view of a playing board.

For a player when using the computer, to place a game piece in the desired position between two nodes, a mouse may be used or alternatively the computer key board may be used if the playing board is referenced as shown for example in FIG. 6. Referring to FIG. 6 the white nodes are referenced by columns A to E and rows 1' to 6'. Similarly, the black nodes are referenced by columns A to F and rows 1' to 5'. With this system of referencing, which may be displayed on the VDU, a user is able to identify any two nodes between which a game piece is to be positioned by keeping in the appropriate column and row references or by placing the mouse on the desired nodes and operating the execute key.

The game when played by two players on the computer is played as described above with reference to the physical apparatus, the only difference being that instead of manually picking up game pieces and placing them between nodes on the board, players enter column and row references in order to select the nodes between which they wish to place a playing tile. By appropriate programming of the software associated with the computer or electronics described above it is possible for one person to play against the computer, the rules of the game being the same as described above, with the computer being the other player. The first player having one colour selects and enters the nodes between which a playing tile is to be placed and the computer then selects nodes representing a desired tile position relating to the other colour. As the tile positions are selected by either the player or the computer the computer screen shows the bands of colour (which may be black or white) representing the tiles in the correct position on the board.

From the foregoing it will be seen that a board game is provided which has many different winning combinations and is intrinsically simple. Thus the game is easy to learn and play, making it suitable for players of many ages.

It will also be apparent that the game is easy to implement on a personal computer or the like.

What is claimed is:

1. Apparatus for a board game comprising:

a playing board having a game piece surface and two sets of irregular-shaped octagonal game pieces, said game piece surface having raised peripheral edges and having two sets of color squares protruding from said game piece surface, said raised peripheral edges extending to a height equal to a height of said two sets of color squares and defining a limited playing area of said game piece surface, each square having four space defining edges, one set of the color squares being completely of a first distinguishing color and the other set of the color squares being completely of a second distinguishing color, the sets of color squares being located in an alternate matrix pattern on the board and the sets being intermingled in an orderly manner so as to provide spaced on said game piece surface to receive said game pieces therein, four boundaries of said spaces being selected from said space defining edges of said color squares and said raised edges of said board, each game piece in one of said sets of game pieces having a band of said first distinguishing color and each game piece in the other set of game pieces having a band of said second distinguishing color, each game piece having a first pair of opposite sides, and each band commencing and terminating on a first and a second of said opposite sides respectively, each of said irregular-shaped octagonal game pieces including four sides of a first length and four sides of a second length, said second length being greater than said first length, said sides of said first length being separated from adjacent sides of said first length by a side of said second length and said side of said second length being separated from adjacent sides of said second length by a side of said first length, said band of said first distinguishing color extending between two of said sides of said first length and said band of said second distinguishing color extending between two of said sides of said first length, said squares having the same dimensions along each side as the width of the bands on each game piece and equal to said first length.

each game piece includes a second pair of opposite sides extending perpendicular to the first pair of opposite sides, the band extending substantially centrally across the game piece parallel to and between the second pair of opposite sides, each said game piece having said second pair of opposite sides is shaped such that when the game piece is placed on the board with said first pair of opposite sides substantially contiguous with respective color squares of said first distinguishing color, then said second pair of opposite sides are substantially contiguous with respective color squares of said second distinguishing color, and when said first pair of opposite sides are placed substantially contiguous with said color squares of said second distinguishing color, then said second pair of opposite sides are substantially contiguous with color squares of said first distinguishing color, the color squares in each of said sets of color squares are arranged in rows with the rows of one set alternating with the rows of the other set with spaces between individual color squares in each row and adjacent rows being offset so that individual color squares in the rows of said sets of color squares are spaced to coincide with the spaces between individual color squares in the rows of the set, each game piece being of a size and shape such that each game piece fits in said space so as to be substantially immovable in said space without manual manipulation and for placement on the board between a selected pair of the fixed squares having the same color as the band on the game piece and in a position with said pair of fixed squares forming extensions of opposite ends of the band and each game piece being of a size and shape to allow said game piece to be placed in said space in an orientation so that said fixed squares form extensions of opposite sides and of a same distinguishing color as that of the band of said game piece whereby continuous series of bands of said first and said second distinguishing colors can be formed across said board by placement of the game pieces, each said series being formed of the appropriately colored squares and the same colored bands on said game pieces and the portions of each square devoid of a band forming a background for the various color bands with adjacent sides of said second length of the game pieces engaging each other to form a raised viewing surface separate from said game piece surface.

* * * * *